US007305777B2

(12) United States Patent
Kettering et al.

(10) Patent No.: US 7,305,777 B2
(45) Date of Patent: Dec. 11, 2007

(54) AUGER FOR SNOW THROW MACHINE

(75) Inventors: Travis Kettering, Ashland, OH (US); Roy G. Pullum, Mansfield, OH (US)

(73) Assignee: MTD Products Inc, Valley City, OH (US)

( * ) Notice: Subject to any disclaimer, the term of this patent is extended or adjusted under 35 U.S.C. 154(b) by 257 days.

(21) Appl. No.: 10/898,825

(22) Filed: Jul. 26, 2004

(65) Prior Publication Data

US 2005/0241190 A1 Nov. 3, 2005

Related U.S. Application Data

(60) Provisional application No. 60/566,475, filed on Apr. 29, 2004.

(51) Int. Cl.
*E01H 5/04* (2006.01)

(52) U.S. Cl. ..... 37/233; 37/258; 37/213; 37/249

(58) Field of Classification Search ..... 37/233, 37/257, 258, 259, 248, 249, 250, 251, 252, 37/254, 256, 213
See application file for complete search history.

(56) References Cited

U.S. PATENT DOCUMENTS

| | | | | |
|---|---|---|---|---|
| 847,961 | A * | 3/1907 | De La Mar | 416/200 R |
| 1,404,692 | A * | 1/1922 | Geist | 198/665 |
| 2,145,882 | A * | 2/1939 | Lathrop | 198/530 |
| 2,610,414 | A * | 9/1952 | Vanvick | 37/251 |
| 3,132,429 | A | 5/1964 | Etnyre | |
| 3,485,341 | A * | 12/1969 | Lutz | 198/664 |
| 3,913,247 | A | 10/1975 | Ruhl | |
| 4,899,471 | A | 2/1990 | Sasaki et al. | |
| 5,123,186 | A * | 6/1992 | Matushita et al. | 37/251 |
| 5,174,053 | A * | 12/1992 | Takeshita | 37/258 |
| 5,209,003 | A | 5/1993 | Maxfield et al. | |
| 5,479,730 | A | 1/1996 | Gogan | |
| 5,893,224 | A | 4/1999 | Harrington et al. | |
| 6,199,306 | B1 | 3/2001 | Kauppila et al. | |
| 6,318,003 | B1 | 11/2001 | Heismann | |
| 6,363,630 | B1 | 4/2002 | Ziegler | |
| 6,499,237 | B2 | 12/2002 | Johnson | |
| 6,499,238 | B2 | 12/2002 | Kluck et al. | |
| 6,508,018 | B1 | 1/2003 | O'Brien | |
| 6,539,649 | B2 * | 4/2003 | Sueshige et al. | 37/245 |
| 6,556,143 | B2 * | 4/2003 | Noah | 340/679 |
| 6,860,041 | B2 * | 3/2005 | Sakai et al. | 37/250 |
| 6,922,921 | B2 * | 8/2005 | Sakai et al. | 37/257 |

* cited by examiner

*Primary Examiner*—Thomas A Beach
(74) *Attorney, Agent, or Firm*—Wegman, Hessler & Vanderburg

(57) ABSTRACT

A snow throwing machine including a housing, an engine, an impeller and an auger for collecting snow and directing it to the impeller. The auger including an auger shaft disposed transversely in the housing and drivable by the engine, and a plurality of flytes mounted on the auger shaft. Each flyte includes a hub and a plurality of fins and is mounted on the auger shaft with a shear pin extending through the hub and auger shaft. The flytes are configured such that an outer peripheral edge of adjacent flytes forms a helix around the auger shaft directing snow toward the impeller.

25 Claims, 4 Drawing Sheets

AUGER FOR SNOW THROW MACHINE

This application claims priority from U.S. Provisional Application Ser. No. 60/566,475, filed Apr. 29, 2004, and entitled AUGER FOR SNOW THROWING MACHINE.

BACKGROUND OF THE INVENTION

1. Field of Invention

This invention relates a snow throwing machine, and more particularly, to a snow throwing machine having an auger formed from a plurality of individually stamped flytes.

2. Description of Related Art

Snow throwers designed to remove snow from sidewalks, driveways and roadways after a snowstorm are well known in the art. Snow throwers can be mounted to a motor vehicle such as a tractor or can be walk-behind models that are self-propelled or manually pushed by the operator. Conventional snow throwers are usually classified as having either a single stage or two stage snow propelling design. Snow throwers typically have a housing with a front opening through which snow is taken in between spaced apart sidewalls and a snow chute and snow deflector through which snow is discharged from the housing. A powered rotating member, such as an impeller or paddle, cuts or sweeps the snow. The impeller is rotated by a power source, such as an internal combustion engine mounted on the snow thrower. In a single stage snow thrower, the impeller or paddle is the only powered device used for collecting and throwing the snow. This may be contrasted with two stage snow throwers which utilize two separate means for consecutively handling the snow. In a conventional two stage model, a snow gathering auger is journalled in a front portion of the snow thrower housing. The auger typically has a pair of opposing helical members that rotate to gather the snow and feed it inwardly toward the center of the housing. The snow then passes through an opening in the housing where an impeller forces the snow up and out of the discharge chute.

Conventional auger designs are functional in gathering the snow and directing it to the impeller, they are, however, not without problems. The helical members are difficult and expensive to manufacture, especially if they are made of a corrosion resistant material. Additionally, if the snow thrower encounters an obstruction, such as a rock or other hard object buried in the snow, one or both of the helical members may break or significant damage to the driving components of the snow thrower may occur. If a helical member breaks, the entire auger must be replaced. Accordingly, there remains a need in the art to improve upon the conventional auger designs to provide more economical and reliable augers for snow throwers.

SUMMARY OF THE INVENTION

The present invention provides an auger for a snow thrower that is made of a plurality of individually stamped blades or flytes. Additionally, the auger is mounted on the snow thrower such that individual flytes can be replaced if they become damaged without having to replace the entire auger. Furthermore, the individual flytes are mounted on the auger shaft such that damage can be limited to the individual flytes and not to the auger transmission or engine.

One aspect of the invention includes an auger for use in a snow throwing machine configured to move snow toward an associated impeller of the snow throwing machine. The auger includes an auger shaft and a plurality of individual flytes mounted on the auger shaft using a shearing member. Each flyte has a central hub and a fin portion, wherein the flytes are mounted on the auger shaft such that an outer peripheral edge of adjacent flytes forms a helix around the auger shaft to direct snow toward the impeller.

Another aspect of the invention is a snow throwing machine including a housing, an engine, an impeller and an auger for collecting snow and directing it to the impeller. The auger includes an auger shaft and a plurality of individual flytes mounted on the auger shaft using a shearing member. Each flyte has a central hub and a fin portion, wherein the flytes are mounted on the auger shaft such that an outer peripheral edge of adjacent flytes forms a helix around the auger shaft to direct snow toward the impeller.

Another aspect of the invention is an auger for use in a snow throwing machine configured to move snow toward an associated impeller of the snow throwing machine. The auger includes an auger shaft and a plurality of individual flytes detachably mounted on the auger. The flytes are mounted on the shaft using a shear pin extending through the central hub and auger shaft. Each flyte includes a central hub and a two generally hemispherically-shaped fins surrounding the central hub and extending substantially 180 degrees. Each fin includes a base portion extending from the hub and an arcuate portion bent at an angle intersecting a longitudinal axis perpendicular to the axis of the auger shaft, wherein a first fin is bent from the longitudinal axis at a first angle and a second fin is bent from the longitudinal axis in the opposite direction such that the fin forms generally an X-shape wherein the flytes are mounted on the auger shaft. The outer peripheral edge of adjacent flytes forms a helix around the auger shaft to direct snow toward the impeller.

Another aspect of the invention is an auger for use in a snow throwing machine configured to move show toward an associated impeller of the snow throwing machine. The auger includes an auger shaft and a plurality of individual flytes mounted on the auger shaft using a shearing member. The flytes are made of a durable and corrosion resistant material such as stainless steel.

Yet another aspect of the invention is a snow throwing machine including a housing, an engine and an impeller operatively connected to the engine. The snow throwing machine also includes an auger operatively connected to the engine for collecting snow and directing it to the impeller, wherein the auger is made of stainless steel. The snow throwing machine also includes a scraping blade configured to push any snow the auger does not capture located at the bottom of the housing behind the auger and substantially spanning the width of the housing, the scraper being made of stainless steel. In one embodiment, the auger has an auger shaft and a plurality of individual flytes mounted on the auger shaft.

These and other features and advantages of this invention are described in, or are apparent from, the following detailed description of various exemplary embodiments of the systems and methods according to this invention.

BRIEF DESCRIPTION OF THE DRAWINGS

The above mentioned and other features of this invention will become more apparent and the invention itself will be better understood by reference to the following description of embodiments of the invention taken in conjunction with the accompanying drawings, wherein.

Corresponding reference characters indicate corresponding parts throughout the views of the drawings.

DETAILED DESCRIPTION OF EXEMPLARY EMBODIMENTS

The invention will now be described in the following detailed description with reference to the drawings, wherein preferred embodiments are described in detail to enable practice of the invention. Although the invention is described with reference to these specific preferred embodiments, it will be understood that the invention is not limited to these preferred embodiments. But to the contrary, the invention includes numerous alternatives, modifications and equivalents as will become apparent from consideration of the following detailed description.

Figure 1:
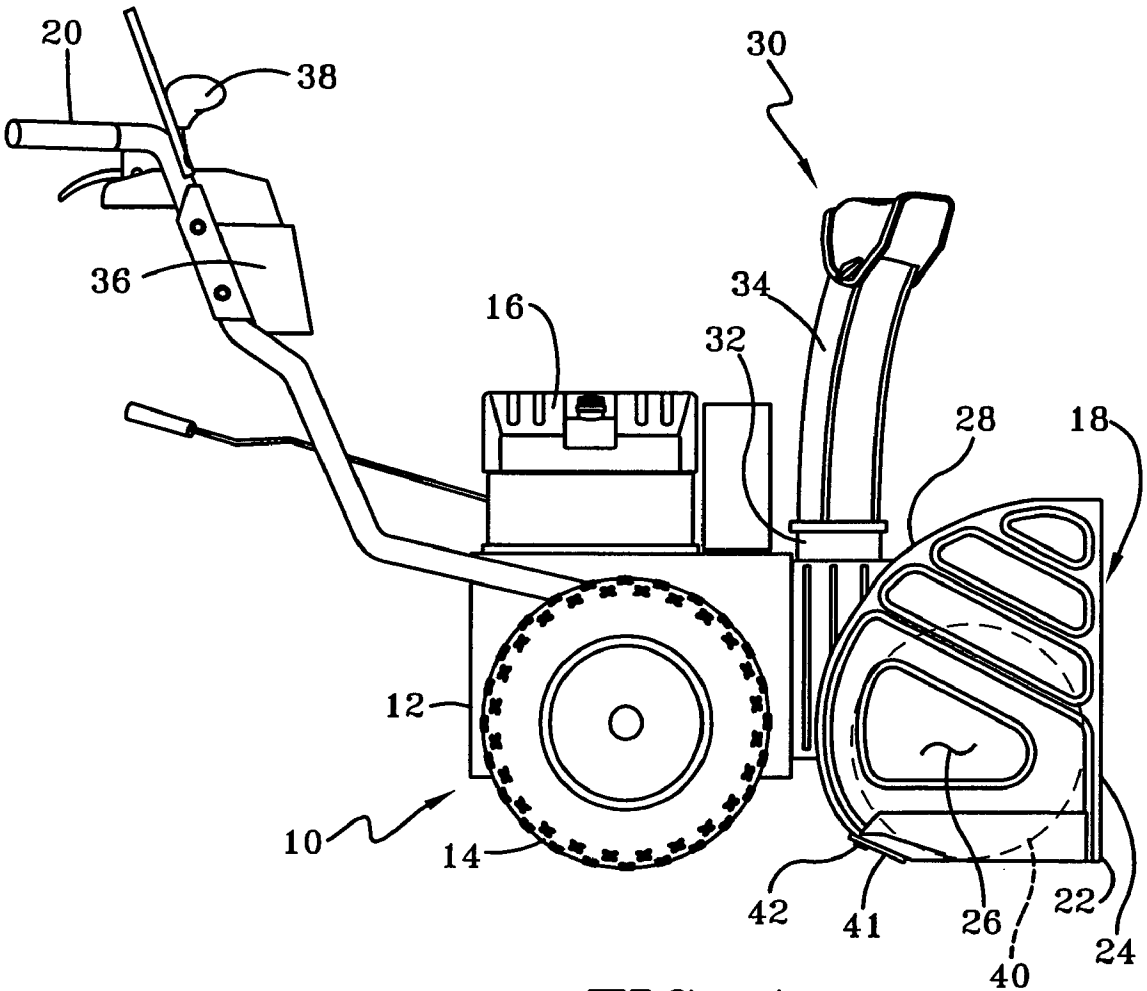
FIG. 1 illustrates a snow throwing machine having a snow gathering unit according to an aspect of the invention.

Referring now to FIG. 1, a walk-behind snow throwing machine is shown generally at 10. The snow thrower 10 includes a frame 12 and ground-engaging wheels 14, operatively coupled to the frame. A power source 16, such as an internal combustion engine or other suitable power source, is fixedly attached to the frame 12 and provides power for operating a snow-gathering unit, indicated generally 18, attached to the front end of the snow thrower 10. In one embodiment, the power source 16 may also be used to provide rotational power to the ground-engaging wheels 14. The snow thrower 10 also includes handles 20, which are rigidly connected to the frame 12 so that an operator may maneuver the snow thrower as desired. The snow-gathering unit 18 includes a housing 22 carried upon the frame 12. It is noted that the illustrated embodiment relates to a walk-behind snow thrower. However, the invention may be incorporated onto a riding vehicle having a snow-gathering unit 18 attached thereto and other applications as well. According to the illustrated embodiment, the snow-gathering 18 unit is a dual stage snow-gathering unit, although other types of snow-gathering units may be incorporated onto the snow thrower 10 as chosen with sound engineering judgment.

The housing 22 includes an open portion 24 in front of a snow-engaging impeller 25. Those skilled in the relevant art will appreciate that the engine 16 may be operatively and selectively coupled to the impeller 25 through a variety of power conveying techniques and approaches, including but not limited to clutches, belts, pulleys, etc. Housing 22 further includes a pair of side walls 26 and a rear wall 28. A discharge chute assembly 30 communicatively cooperates with the open front portion 24 for accepting and directing snow ejected from the impeller 25 into an intended direction of dispersion. Discharge chute assembly 30 includes a chute 32 and a deflector 34 which are interconnected at their overlapping ends so as to pivot to a desired angle for directing the snow away from the snow thrower 10. The snow thrower 10 further includes a console or control panel 36 from which extends a joystick or control lever 38. The control lever 38 is used as a remote control device for rotational positioning of the chute assembly 30. Those skilled in the relevant art will appreciate that the positioning of the chute assembly 30 may alternatively be controlled via a chute crank assembly (not shown), a remote crank assembly (not shown), or a cable assembly (not shown).

Figure 2:
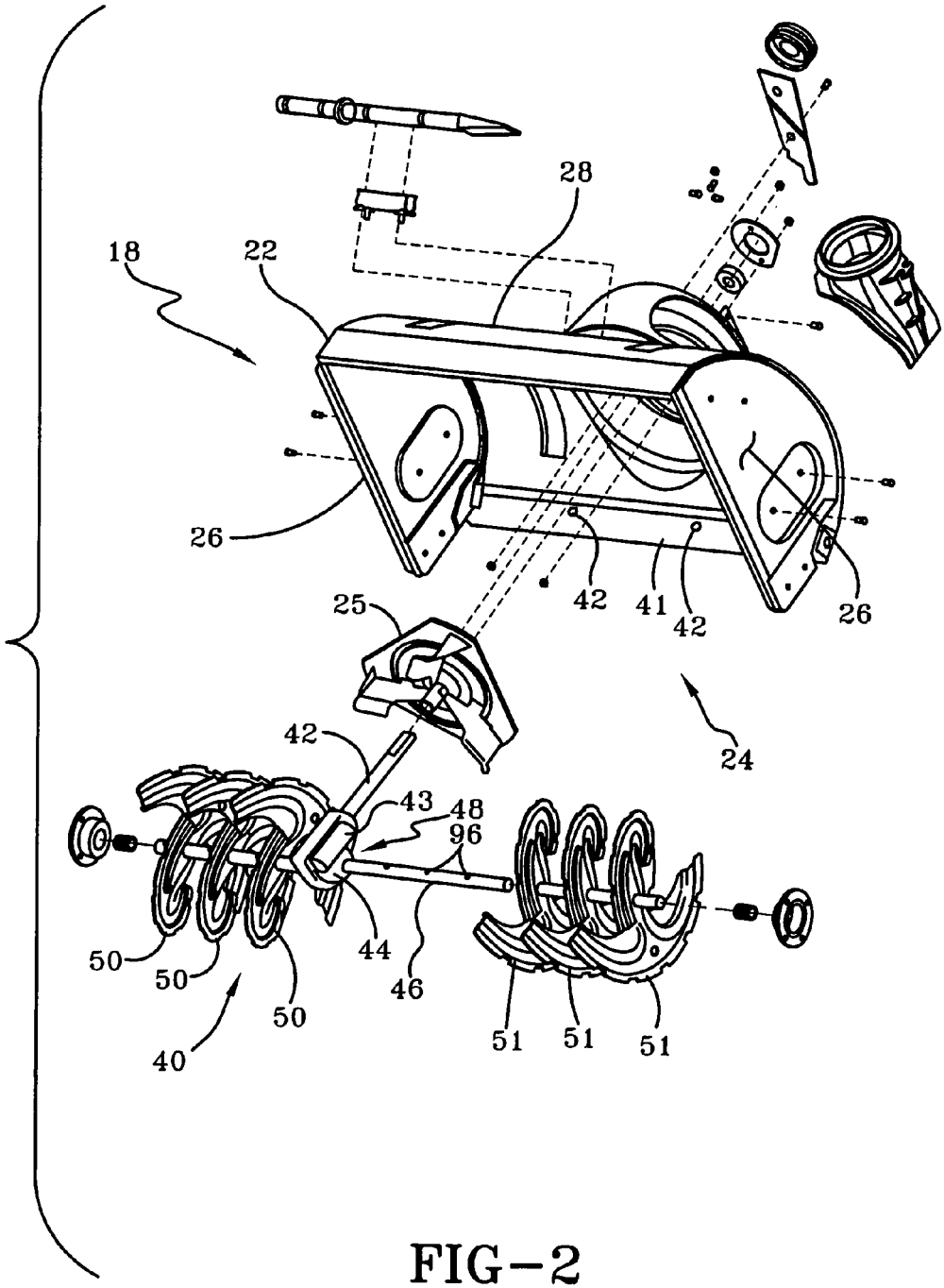
FIG. 2 is an exploded perspective view of the snow gathering unit of the snow throwing machine of FIG. 1 including an auger for gathering snow.

Referring now to FIG. 2, as the snow thrower 10 travels over the snow, snow entering the open portion 24 of the housing 22 is channeled toward the impeller 25 by an auger 40. Once the snow reaches the impeller 25, the impeller propels the snow through the chute assembly 30. The engine 16 (FIG. 1) is coupled to an impeller/auger input shaft 42. The input shaft 42 is positioned generally centrally in the transverse direction of the snow thrower 10 and extends longitudinally through the housing 22. The impeller 25 is mounted on the input shaft 42 using convention means. The input shaft 42 has on its front end a worm 43 meshing with a worm gear 44 on the center of an auger drive shaft 46 extending transversely through the housing 22. The worm 43 and the worm gear 44 jointly constitute an auger transmission 48. The transmission of power from the engine 16 to the impeller 25 and auger 40 can be through convention means understood by those skilled in the art and need not be discussed in further detail.

A scraping blade 41 is located at the bottom of the housing 22 behind the auger 40 and spans preferably the entire width of the housing 22. The scraping blade 41 is fastened to the housing 22 using suitable fasteners 42, although other methods of fastening the scraping blade to the housing such as welding may be used. The scraping blade 41 functions to push any snow the auger 40 does not capture back into the housing 22. As snow accumulates in front of the scraping blade, it is picked up by the auger. In one embodiment, the scraping blade 41 is made of a durable and corrosion resistant material such as stainless steel, although other materials may be used.

According to the invention, the auger 40 is formed with a plurality of individual discs or flytes 50, 51. In the embodiment shown in FIG. 2, three flytes 50 are attached to the auger drive shaft 46 on one side of the auger transmission 48 and three flytes 51 are attached to the auger drive shaft on the opposite side of the auger transmission. In the embodiment shown in FIG. 3, two flytes are attached to the auger drive shaft 46 on each side of the auger transmission. Thus, snow throwers 10 having differing housing width dimensions can be accommodated using standard parts simply by selecting the proper length of auger drive shaft 46 and adding or removing individual flytes 50, 51 to conform to the dimensions of the housing 22. For example, and not by way of limitation, a snow thrower 10 having a 22-inch width can be constructed with two flytes 50, 51 on each side of the transmission 48, while a snow thrower having a 30-inch width can be constructed with three flytes on each side. Flytes 50 on a first side of the transmission and flytes 51 on the opposite side are substantially the mirror image of each other so as to direct the snow toward the center of the housing 22 from their respective sides. Therefore, only the flytes 50 will be described below and the structure of the flytes 51 can easily be understood from the description of the flytes 50.

Figure 4:
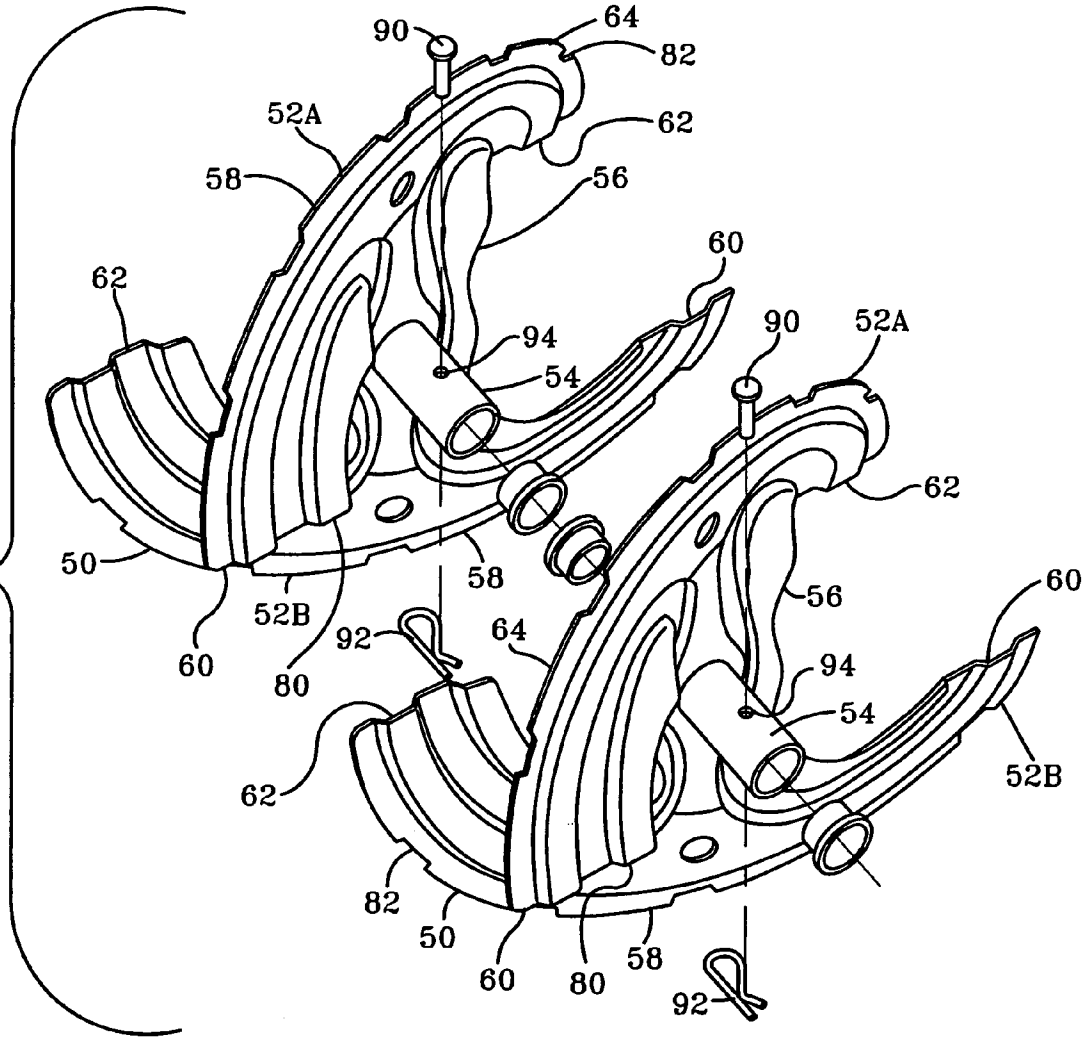
FIG. 4 is an enlarged exploded perspective view of the auger flytes of FIG. 3.

Referring now to FIG. 4, flyte 50 comprises two generally hemispherically-shaped fins 52A and 52B surrounding a central hub 54. Each fin 52A, 52B comprises a base 56 extending from the hub 54 and an arcuate portion 58 extending at an angle that intersects the longitudinal axis of the housing 22. As shown in FIG. 4, fin 52A is bent from the longitudinal axis at a first angle and fin 52B is bent from the longitudinal in the opposite direction such that the fins form generally an X-shape. Fins 52A, 52B are preferably oriented at an angle between 10 and 50 degrees from the longitudinal axis, and more preferably between 20 and 40 degrees.

Desirably, each fin 52A, 52B extends substantially 180 degrees such that leading edges 60 on the fins of the first flyte 50 are joined or nearly joined to trailing edges 62 on the fins of the adjacent flyte so that their outer peripheral edges 64 jointly form a helix around the auger shaft 46. The helical structure of the fins 52A, 52B allows the flights 50 to form a generally cylindrical shape when they are rotated around the shaft 46. The outer peripheral edges 64 of the flytes 50, 51 form a substantially continuous helix around the auger drive shaft 46, which covers substantially the entire length of the drive shaft 46 with exception of its middle portion near the auger transmission 48.

Figure 3:
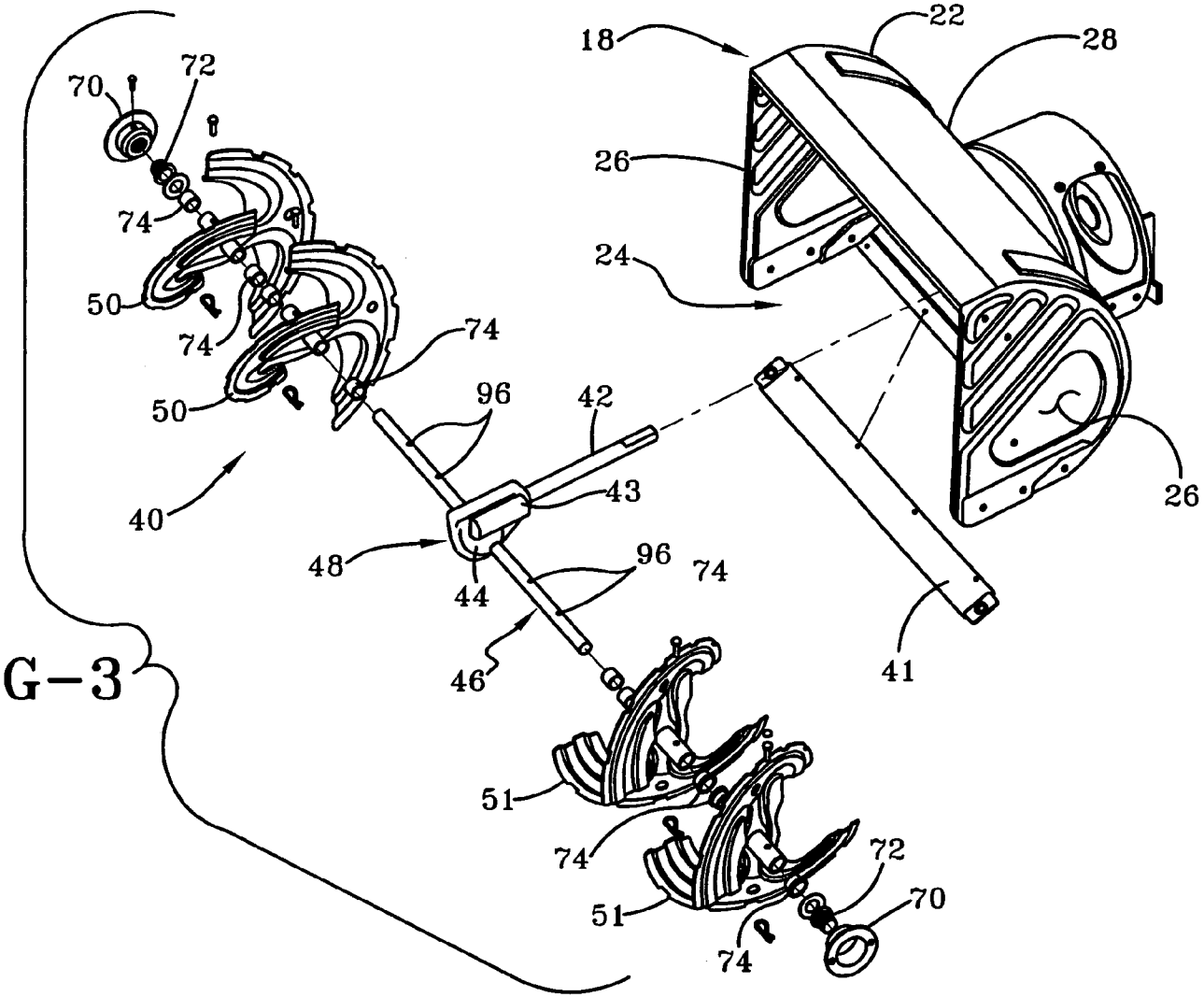
FIG. 3 is an exploded perspective view of the snow throwing machine showing the individual flytes forming the auger.

As shown in FIGS. 2 and 3, the opposite ends of the auger drive shaft 46 are rotatably journalled on housing side walls 26, respectively, by bearing housing 70 mounted on the side wall and bearing 72. Spacers 74 axially position the flytes in the desired location along the auger drive shaft 46. The auger drive shaft 46 is rotated about its own axis when the input shaft 42 is rotated. When the auger drive shaft 46 is rotated, snow positioned in front of the auger 40 is collected by the flytes 50, 51 toward the center in the transverse direction and rearward toward the impeller 25. Therefore, snow can effectively be collected without leakage between the successive flytes 50, 51 which are continuously held in helical alignment at their edges during operation of the auger 40 similar to conventional augers with continuous blades.

Desirably, the flytes 50, 51 are made of a durable and corrosion resistant metal, such as stainless steel. Alternately, the flytes 50, 51 are made other durable materials, such as carbon steel or the like. In one embodiment, ridges 80 are formed in the body of the fin 52 to impart structural strength to the flyte 50, 51. Teeth 82 in the peripheral edges 64 of the flytes 50, 51 aid in cutting the snow. Individual flytes 50, 51 can be stamp formed and then joined together on the auger shaft 46 to facilitate manufacturing of the auger 40. The fins 52A, 52B on adjacent flytes 50, 51 can be angled so that the edges substantially contact each other without requiring the use of fasteners or a mechanical joining process to hold the edges together when positioned on the auger shaft 46. Alternately, adjacent flytes 50, 51 can be structurally joined, such as by welding or using suitable fasteners.

Each flyte 50, 51 is detachably attached to the auger drive shaft 46 by means of a shear pin 90 and cotter pin 92, or more broadly, a shearing member. Holes 94 in the hub 54 are aligned with corresponding holes 96 in the auger drive shaft 46 such that the shear pin 90 is passed through the hub 54 and auger drive shaft 46 to attach the flyte 50, 51 to the shaft so that rotation of the shaft causes rotation of the flyte. If one of the flytes 50 should encounter an obstruction in the snow during operation of the snow thrower 10, the shear pin 90 is desirably designed to fail before damage to the auger transmission 48 occurs or before the flyte 50 would break. Thus, encountering an obstruction that leads to a the shearing of one shear pin 90 does not render the entire snow thrower 10 inoperable as the remaining flytes 50, 51 will continue to operate to push the snow toward the impeller 25 until the failed flyte can be repaired or replaced. Furthermore, since the auger 40 is constructed of mutually separate flytes 50, 51, the entire auger is not required to be replaced in its entirety when one of the flytes should break. Accordingly, the maintenance procedure for the snow thrower 10 is simplified.

While this invention has been described in conjunction with the specific embodiments described above, it is evident that many alternatives, combinations, modifications and variations are apparent to those skilled in the art. Accordingly, the preferred embodiments of this invention, as set forth above are intended to be illustrative only, and not in a limiting sense. Various changes can be made without departing from the spirit and scope of this invention.

What is claimed is:

1. An auger for use in a snow throwing machine configured to move snow toward an associated impeller of said snow throwing machine, said auger comprising: an auger shaft and a plurality of individual flytes detachably mounted on said auger shaft, each flyte comprising a central hub and two generally hemispherically-shaped fins surrounding the central hub, wherein each flyte is mounted on the auger shaft using a shear pin extending through the central hub and auger shaft, and wherein each fin comprises a base portion extending from the hub and an arcuate portion bent at an angle intersecting a longitudinal axis perpendicular to the axis of the auger shaft, wherein a first fin is bent from the longitudinal axis at a first angle and a second fin is bent from the longitudinal axis in the opposite direction such that the fins form generally an X-shape, wherein each fin extends substantially 180 degrees such that a leading edge on the fin of a first flyte is substantially joined to a trailing edge on the fin of an adjacent flyte so that outer peripheral edges of adjacent flytes jointly form a helix around the auger shaft.

2. The auger for a snow throwing machine of claim 1 wherein the flytes are detachably attached to the auger shaft such that first and second flytes are mounted on a first portion of the auger shaft extending in a first direction from said transmission, said second flyte being mounted outboard said first flyte, and third and fourth flytes are mounted on a second portion of the auger shaft extending in a second direction from said transmission, said fourth flyte being mounted outboard said third flyte.

3. The auger for a snow throwing machine of claim 2 wherein the shearing member comprises a shear pin extending through the central hub and auger shaft and a cotter pin for holding the shear pin in place.

4. The auger for a snow throwing machine of claim 3 wherein the hemispherically-shaped fins extending from the central hub on the first and second flytes are configured such that a leading edge of a first fin on the second flyte is proximate a trailing edge of a second fin on the first flyte and a leading edge of a second fin on the second flyte is proximate a trailing edge of a first fin on the first flyte.

5. The auger for a snow throwing machine of claim 1 wherein the fin portion of each flyte is stamp formed from a single piece of material.

6. The auger for a snow throwing machine of claim 1 wherein each flyte further comprises at least one ridge formed in the body of the fin.

7. The auger for a snow throwing machine of claim 1 wherein each flyte further comprises a plurality of teeth in the peripheral edge of the flyte.

8. The auger for a snow throwing machine of claim 1 wherein the flytes are made of stainless steel.

9. The auger for a snow throwing machine of claim 1 wherein the auger shaft is connectable to the snow throwing machine near a midpoint of the auger shaft such that said auger shaft is divided into first and second sides and said auger comprises two flytes on said first side of the auger shaft and two flytes on said second side of the auger shaft.

10. The auger for a snow throwing machine of claim 1 wherein the auger shaft is connectable to the snow throwing machine near a midpoint of the auger shaft such that said auger shaft is divided into first and second sides and said auger comprises three flytes on said first side of the auger shaft and three flytes on said second side of the auger shaft.

11. A snow throwing machine for moving snow, the machine comprising a housing, an engine, an impeller, an auger for collecting snow and directing it to the impeller, and a transmission connecting said auger to said engine, said auger comprising an auger shaft connected to said transmission near a midpoint of said auger shaft and a plurality of individual flytes mounted on said auger shaft on each side of said transmission, each flyte comprising a central hub and a fin portion comprising two generally hemispherically-shaped fins surrounding the central hub, wherein each flyte is mounted on the auger shaft using a shearing member attaching the central hub of the flyte to the auger shaft, and wherein each fin comprises a base portion extending from the hub and an arcuate portion bent at an angle intersecting a longitudinal axis perpendicular to the axis of the auger shaft, wherein a first fin is bent from the longitudinal axis at a first angle and a second fin is bent from the longitudinal axis in the opposite direction such that the fins form generally an X-shape, wherein each fin extends substantially 180 degrees such that a leading edge on the fin of a first flyte is substantially joined to a trailing edge on the fin of an adjacent flyte so that the outer peripheral edge of the flytes jointly form a helix around the auger shaft to direct snow toward the impeller.

12. The snow throwing machine of claim 11 further comprising a scraping blade configured to push any snow the auger does not capture located at the bottom of the housing behind the auger and substantially spanning the width of the housing, said scraper being made of stainless steel.

13. The snow throwing machine of claim 11 wherein the flytes are detachably attached to the auger shaft such that first and second flytes are mounted on a first portion of the auger shaft extending in a first direction from said transmission, said second flyte being mounted outboard said first flyte, and third and fourth flytes are mounted on a second portion of the auger shaft extending in a second direction from said transmission, said fourth flyte being mounted outboard said third flyte.

14. The snow throwing machine of claim 13 wherein the shearing member comprises a shear pin extending through the central hub and auger shaft and a cotter pin holding the shear pin in place.

15. The snow throwing machine of claim 14 wherein the hemisperically-shaped fins extending from the central hub on the first and second flytes are configured such that a leading edge of a first fin on the second flyte is proximate a trailing edge of a second fin on the first flyte and a leading edge of a second fin on the second flyte is proximate a trailing edge of a first fin on the first flyte.

16. The snow throwing machine of claim 11 wherein the fin portion of each flyte is stamp formed from a single piece of material.

17. The auger snow throwing machine of claim 11 wherein each flyte further comprises at least one ridge formed in the body of the fin.

18. The snow throwing machine of claim 11 wherein each flyte further comprises a plurality of teeth in the peripheral edge of the flyte.

19. A snow throwing machine for moving snow comprising:

an engine;

an impeller;

a transmission;

an auger rotated by said engine through said transmission for collecting snow and directing it to the impeller, said auger comprising:

an auger shaft connected to said transmission such that a first portion of said auger shaft extends in a first direction from said transmission and a second portion of said auger shaft extends in a second direction from said transmission;

a first flyte mounted on the first portion of the auger shaft, said first flyte having a central hub and two generally hemispherically-shaped fins extending from the central hub, wherein the first flyte is mounted on the auger shaft using a shearing member attaching the central hub of the flyte to the auger shaft;

a second flyte mounted on the first portion of the auger shaft outboard of said first flyte, said second flyte having a central hub and two generally hemispherically-shaped fins extending from the central hub, wherein the second flyte is mounted on the auger shaft using a shearing member attaching the central hub of the flyte to the auger shaft;

a third flyte mounted on the second portion of the auger shaft, said third flyte having a central hub and two generally hemispherically-shaped fins extending from the central hub, wherein the third flyte is mounted on the auger shaft using a shearing member attaching the central hub of the flyte to the auger shaft;

a fourth flyte mounted on the second portion of the auger shaft outboard of the third flyte, said fourth flyte having a central hub and two generally hemispherically-shaped fins extending from the central hub, wherein the fourth flyte is mounted on the auger shaft using a shearing member attaching the central hub of the flyte to the auger shaft;

wherein the outer peripheral edges of the first and second flytes form a helix around the auger shaft such that the flytes direct snow toward the impeller, and the outer peripheral edges of the third and fourth flytes form a helix around the auger shaft such that the flytes direct snow toward the impeller.

20. The snow throwing machine of claim 19 wherein each fin comprises a base portion extending from the hub and an arcuate portion bent at an angle intersecting a longitudinal axis perpendicular to the axis of the auger shaft, wherein a first fin is bent from the longitudinal axis at a first angle and a second fin is bent from the longitudinal axis in the opposite direction.

21. The snow throwing machine of claim 20 wherein the first and second flytes are configured such that a leading edge of a first fin on the second flyte is proximate a trailing edge of a second fin on the first flyte and a leading edge of a second fin on the second flyte is proximate a trailing edge of a first fin on the first flyte.

22. The snow throwing machine of claim 19 wherein said transmission comprises a worm rotated by said engine and a worm gear mounted near a midpoint of said auger shaft.

23. The snow throwing machine of claim 19 further comprising a fifth flyte mounted on the first portion of the auger shaft outboard of said second flyte, said fifth flyte having a central hub and two generally hemispherically-shaped fins extending from the central hub, wherein the fifth flyte is mounted on the auger shaft using a shearing member attaching the central hub of the flyte to the auger shaft, and a sixth flyte mounted on the second portion of the auger shaft outboard of the fourth flyte, said sixth flyte having a central hub and two generally hemispherically-shaped fins extending from the central hub, wherein the sixth flyte is mounted on the auger shaft using a shearing member attaching the central hub of the flyte to the auger shaft.

24. The snow throwing machine of claim 19 wherein the first and second flytes are identical.

25. An auger rotatable via an auger shaft for use in a snow throwing machine, said auger comprising a plurality of individual flytes, each flyte comprising a central hub and two generally hemispherically-shaped fins surrounding the central hub, wherein each flyte receives a shear pin extending through the central hub so as to be mountable on the auger shaft, and wherein each fin comprises a base portion extending from the hub and an arcuate portion bent at an angle intersecting a longitudinal axis perpendicular to the axis of the auger shaft, wherein a first fin is bent from the longitudinal axis at a first angle and a second fin is bent from the longitudinal axis in the opposite direction such that the fins form generally an X-shape, wherein each fin extends substantially 180 degrees such that a leading edge on the fin of a first flyte is substantially joined to a trailing edge on the fin of an adjacent flyte so that the outer peripheral edges of adjacent flytes jointly form a helix.

* * * * *